US008328145B2

(12) United States Patent
Smith

(10) Patent No.: US 8,328,145 B2
(45) Date of Patent: Dec. 11, 2012

(54) METHOD AND APPARATUS FOR DISTRIBUTED POWER TRAIN CONTROL

(75) Inventor: Eugene Andrew Smith, Satellite Beach, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/218,133

(22) Filed: Aug. 25, 2011

(65) Prior Publication Data

US 2011/0309206 A1 Dec. 22, 2011

Related U.S. Application Data

(62) Division of application No. 11/549,211, filed on Oct. 13, 2006.

(51) Int. Cl.
*B61L 23/00* (2006.01)

(52) U.S. Cl. ..... 246/187 C; 246/167 R; 246/169 R; 701/19

(58) Field of Classification Search ..... 246/167 R, 246/169 R, 3, 4, 186, 187 R, 187 A, 187 C; 701/19, 2, 1; 340/900, 902
See application file for complete search history.

(56) References Cited

U.S. PATENT DOCUMENTS

| | | | | |
|---|---|---|---|---|
| 5,720,455 | A * | 2/1998 | Kull et al. | 246/187 C |
| 6,401,015 | B1 * | 6/2002 | Stewart et al. | 701/19 |
| 6,862,502 | B2 * | 3/2005 | Peltz et al. | 701/19 |
| 2004/0124697 | A1 * | 7/2004 | MacGregor et al. | 303/89 |

* cited by examiner

*Primary Examiner* — Mark Le
(74) *Attorney, Agent, or Firm* — GE Global Patent Operation; John A. Kramer

(57) ABSTRACT

A method for controlling a railroad train (10) comprising a lead unit (14), a remote unit (12A) and a communications system communicating information between the lead unit (14) and the remote unit (12A), wherein the lead unit (14) and the remote unit (12A) are each operable in a traction operational mode and a dynamic brake operational mode. The method comprises determining operability of the communications system; determining a direction of train travel; determining an operational mode of the lead unit (14) and the remote unit (12A); and indicating a train condition responsive to the operability of the communications system, the direction of train travel and the operational mode of the lead (14) and remote units (12A).

16 Claims, 5 Drawing Sheets

METHOD AND APPARATUS FOR DISTRIBUTED POWER TRAIN CONTROL

CROSS-REFERENCE TO RELATED APPLICATIONS

This is a divisional application of and claims priority to U.S. patent application Ser. No. 11/549,211, filed on Oct. 13, 2006, the entirety of which is incorporated herein by reference.

FIELD OF THE INVENTION

This invention relates generally to distributed power train control system and more particularly to an apparatus and method for distributed power train control during an interruption in a communications component of the distributed power system.

BACKGROUND OF THE INVENTION

Distributed power railroad train operation supplies motive power and braking action from a lead locomotive (or lead unit) and from one or more remote locomotives (or remote units) spaced apart from the lead unit in a railroad train. Distributed power train operation may be preferable for long train consists to improve train handling and performance, especially for trains operating over mountainous terrain.

A distributed power train control and communications system generates traction and braking commands responsive to operator-initiated control of a traction (or throttle) controller (throttle handle) or a braking controller (brake handle) in the lead unit The commands are transmitted to the remote locomotives over a radio frequency communications system (such as the LOCOTROL® distributed power train communications system available from the General Electric Company of Schenectady, N.Y.) including receiving and transmitting components at the lead and the remote units for communicating over a radio frequency link (channel).

For example, when the lead unit operator operates the lead-unit throttle controller to apply tractive effort from the lead unit, the distributed power control and communications system commands each remote unit to supply the same tractive effort. Upon execution of the received command, each remote unit responds to the lead unit with a reply message indicating implementation of the tractive effort command. The distributed power control and communications system can be configured to various operational modes that affect interaction between the lead and remote units and the implementation of lead unit commands at the remote unit.

The lead unit also sends other message types to the remote units, such as status request messages, to which the remote units respond by sending a status reply message back to the lead unit. The status reply message indicates the current operational status of the replying remote unit.

The train braking system includes a locomotive brake system in each locomotive (including the lead locomotive and all the remote locomotives) and a railcar air brake system at each railcar. The operator in the lead unit controls the locomotive brakes by positioning an independent brake handle (controller), and controls the rail car brakes by positioning an automatic brake handle (controller). Each locomotive further includes a dynamic brake system described further below.

The railcar air brake system includes a pressure sensing apparatus, a plurality of valves and interconnecting piping and brake shoes at each railcar wheel. A fluid-carrying brake pipe extending the length of the train is in fluid communication with the car brake system at each railcar. Operator control of the automatic brake handle in the lead locomotive initiates a pressure change at the lead unit that propagates along the brake pipe. The pressure sensing apparatus at each railcar detects a pressure differential relative to a reference pressure and responsive thereto initiates a brake application (if a pressure below the reference pressure is detected) or a brake release (if a pressure above the reference pressure is detected). Several seconds may be required for the for the fluid pressure change to reach each railcar of the train, resulting in uneven application of braking forces at each railcar.

The lead and remote locomotives further include a dynamic brake system controllable by the operator. Activation of the dynamic brakes reconfigures the traction motors to generator operation, with the locomotive wheels supplying rotational energy to turn the generator rotor winding. Magnetic forces developed by generator action resist wheel rotation and thus create wheel-braking forces. The energy produced by the generator is dissipated as heat in a resistor grid in the locomotive and removed from the grid by one or more cooling blowers. Use of the dynamic brakes is indicated to slow the train when application of the locomotive independent brakes and/or the railcar air brakes may cause the locomotive or railcar wheels to overheat or when prolonged use of the independent brakes and/or the railcar brakes may cause excessive wheel wear. For example, the dynamic brakes are applied when the train is traversing a prolonged downgrade.

In a distributed power train, in addition to regulating the brake pipe pressure to effect application and release of the railcar brakes, operation of the automatic brake handle in the lead unit commands remote unit brake applications and releases by transmitting a brake application/release signal to the remote units via the communications channel. If the communications link between the lead and remote units is operative, the remote units receive the brake application signal and initiate brake pipe venting from their location in the train. Since each remote unit receives the brake application command before it senses the brake pipe pressure change, the railcar brakes are applied sooner than if the brake application signal is carried only over the brake pipe. Braking is thus accomplished by venting the brake pipe at the lead and remote locomotives, accelerating the brake pipe venting and application of the brakes at each railcar, especially for those railcars near the end of the train. If the communications link between the lead and remote locomotives is operative, the brake release command received by each remote locomotive is executed at each remote locomotive by charging the brake pipe to a nominal pressure, thereby releasing the rail car brakes and advantageously reducing the time required to recharge the brake pipe.

When the lead operator applies the dynamic brakes of the lead unit, an appropriate communications signal is transmitted to the remote units to activate the dynamic brakes at each remote unit. A dynamic brake release signal is similarly transmitted from the lead unit to the remote units.

In general, traction and braking messages sent over the communications system result in the application of more even tractive forces to the railcars and improve braking performance, as each locomotive can effect a brake application or release at the speed of the RF signal, rather than the slower speed at which the pneumatic brake pipe braking signal propagates along the train.

If the communications system is inoperative or the communications link between the lead unit and one or more remote units is disrupted (for example, if line-of-sight directivity is lost due to track topology or an interfering object), lead initiated braking and traction commands are not received by the remote unit(s). In particular, if the lead operator commands a return to tractive effort from a dynamic brake application, the remote units will not receive the tractive effort command. The lead unit applies tractive effort while the remote units are in a dynamic braking mode. This situation generates substantial in-train forces that can break the train and/or cause a train derailment. As operating trains grow heavier and longer, the likelihood of a train break or derailment is greater.

BRIEF DESCRIPTION OF THE INVENTION

In one embodiment the invention relates to an apparatus for a railroad train comprising a lead unit, a remote unit and a plurality of railcars, wherein a communications system communicates information between the lead unit and the remote unit, the lead unit controlled by operation of lead unit controls and the remote unit controlled by commands issued from the lead unit to the remote unit over the communications system. In this embodiment the apparatus comprises a lead unit controller for controlling an operational mode of the lead unit; a remote unit controller for controlling an operational mode of the remote unit; and a system controller responsive to a status signal indicating an inoperable communications system, responsive to a direction signal indicating a direction of train travel and responsive to the operational mode of the lead and the remote units, the system controller producing an indication of the train condition.

In another embodiment the invention comprises a method for controlling a railroad train comprising a lead unit, a remote unit and a communications system communicating information between the lead unit and the remote unit, wherein the lead unit and the remote unit are each operable in a traction operational mode and a dynamic brake operational mode. According to this embodiment the method comprises determining operability of the communications system; determining a direction of train travel; determining an operational mode of the lead unit and the remote unit; and indicating a train condition responsive to the operability of the communications system, the direction of train travel and the operational mode of the lead and remote units.

In yet another embodiment the invention comprises a method for controlling a railroad train comprising a lead unit, a remote unit and a communications system communicating information between the lead unit and the remote unit, wherein the lead unit and the remote unit are each operable in a traction operational mode and a dynamic brake operational mode. In this embodiment the method comprises determining that a signal sent from the lead unit to the remote unit over the communications system has not been received by the remote unit; determining a reverse direction of train travel; determining that the lead unit is in the traction operational mode; determining that the remote unit was last known to be in the traction operational mode; and producing a train condition indicating signal.

In still another embodiment the invention comprises a method for controlling a railroad train comprising a lead unit, a remote unit and a communications system communicating information between the lead unit and the remote unit, wherein the lead unit and the remote unit are each operable in a traction operational mode and a dynamic brake operational mode. According to this embodiment the method comprises determining that a signal sent from the lead unit to the remote unit over the communications system has not been received by the remote unit; determining a forward direction of train travel; determining that the lead unit is in the dynamic brake operational mode; determining that the remote unit was last known to be in the dynamic braking operational mode; and producing a train condition indicating signal.

BRIEF DESCRIPTION OF THE DRAWINGS

The exemplary embodiments of the present invention can be more easily understood and the further advantages and uses thereof more readily apparent, when considered in view of the following detailed description when read in conjunction with the following figures, wherein.

In accordance with common practice, the various described features are not drawn to scale, but are drawn to emphasize specific features relevant to the embodiments of the invention. Reference characters denote like elements throughout the figures and text.

DETAILED DESCRIPTION OF THE INVENTION

The following embodiments are not intended to define limits of the structures or processes of the exemplary embodiments of the invention, but only to provide exemplary constructions. The embodiments are permissive rather than mandatory and illustrative rather than exhaustive.

Throughout the description of the embodiments of the invention, the terms "radio link", "RF (radio frequency) link" and "RF communications" and similar terms describe a method of communicating between two links in a network, such as a lead and a remote locomotive of a distributed power train. It should be understood that the communications link between nodes (locomotives) in the system is not limited to radio or RF systems or the like and is meant to cover all techniques by which messages may be delivered from one node to another or to plural others, including without limitation, magnetic systems, acoustic systems and optical systems. Likewise, the invention is not limited to a described embodiment in which RF links are used between nodes and in which the various components are compatible with such links.

Figure 1:
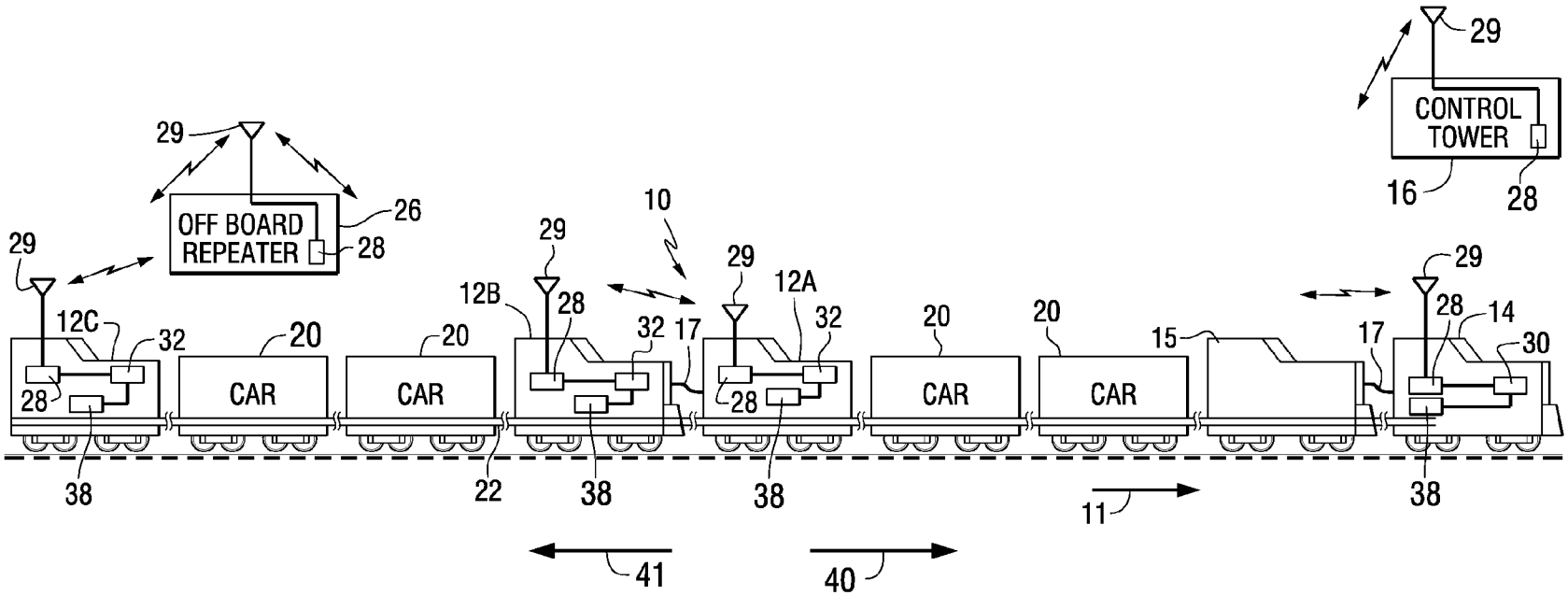
FIG. 1 is a schematic diagram of a distributed power railroad train.
Figure 2A:
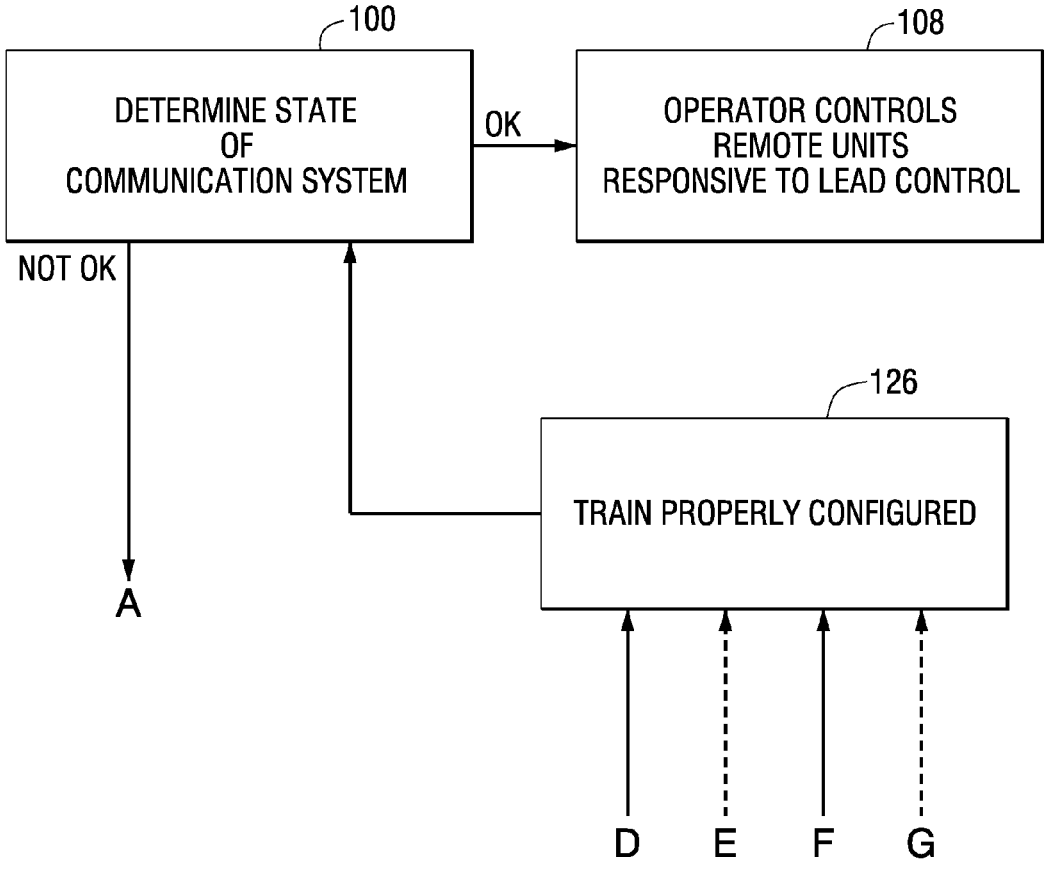
FIGS. 2A-2D depict a state diagram of a control system according to an exemplary embodiment of the invention.
Figure 2B:
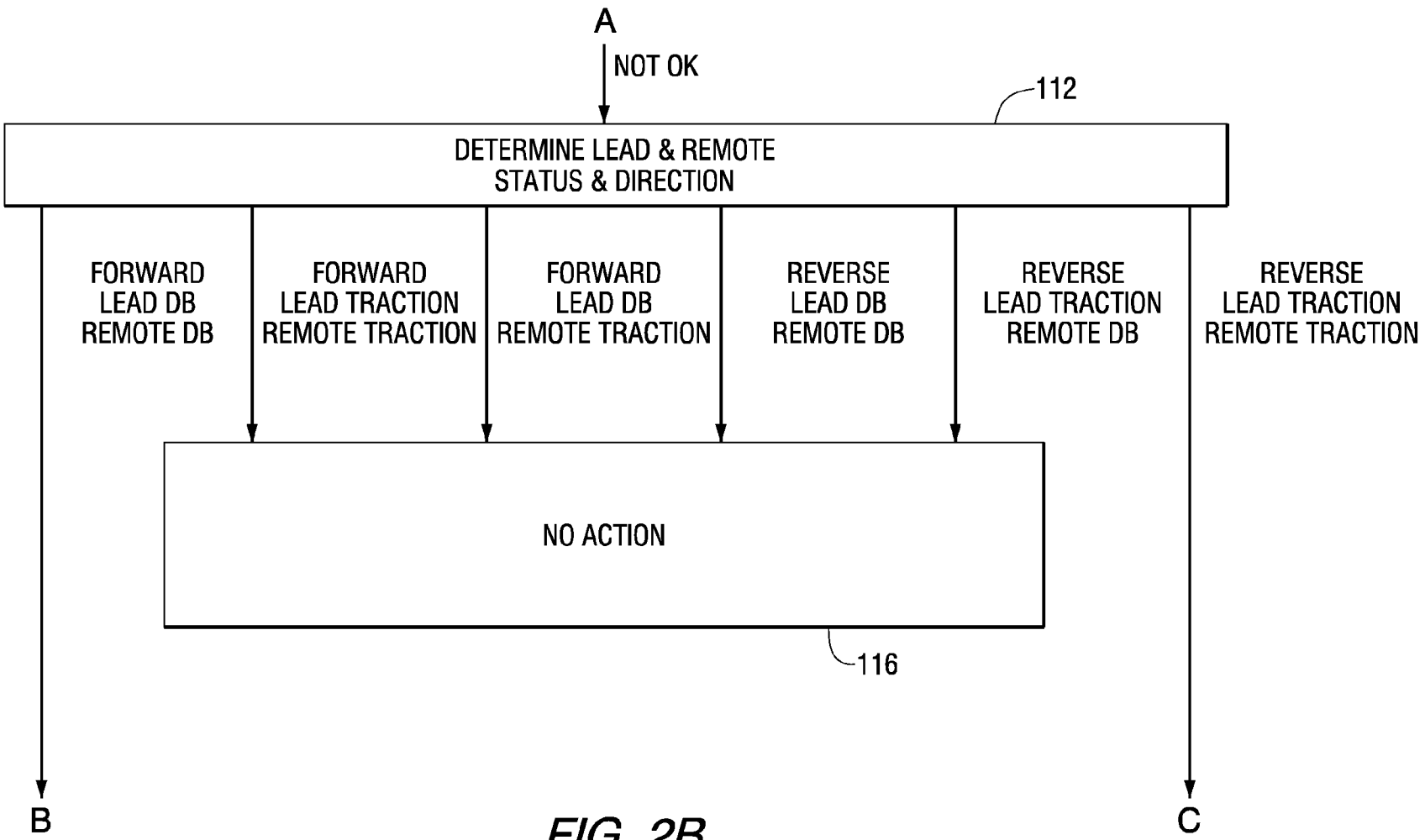
Figure 2C:
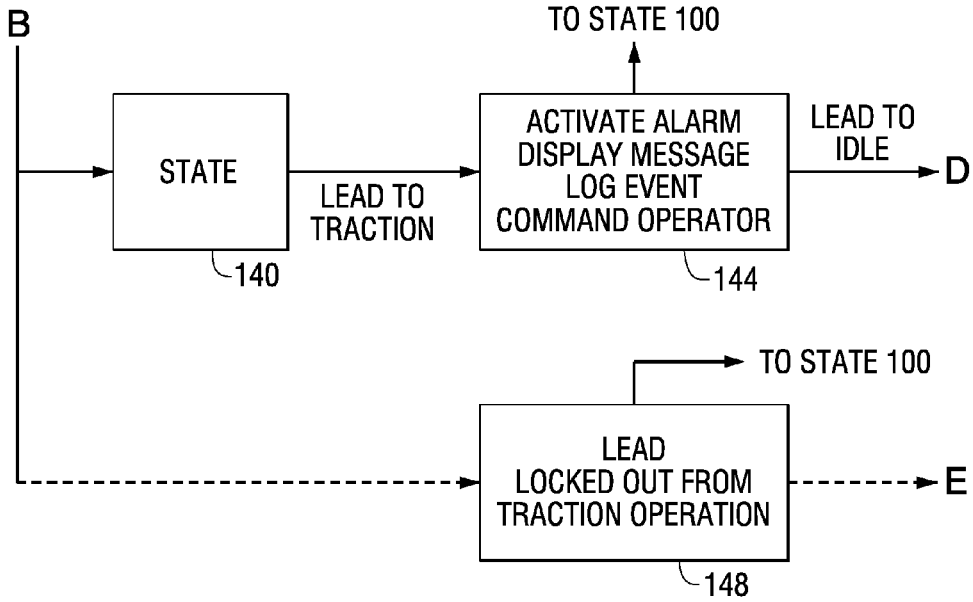
Figure 2D:
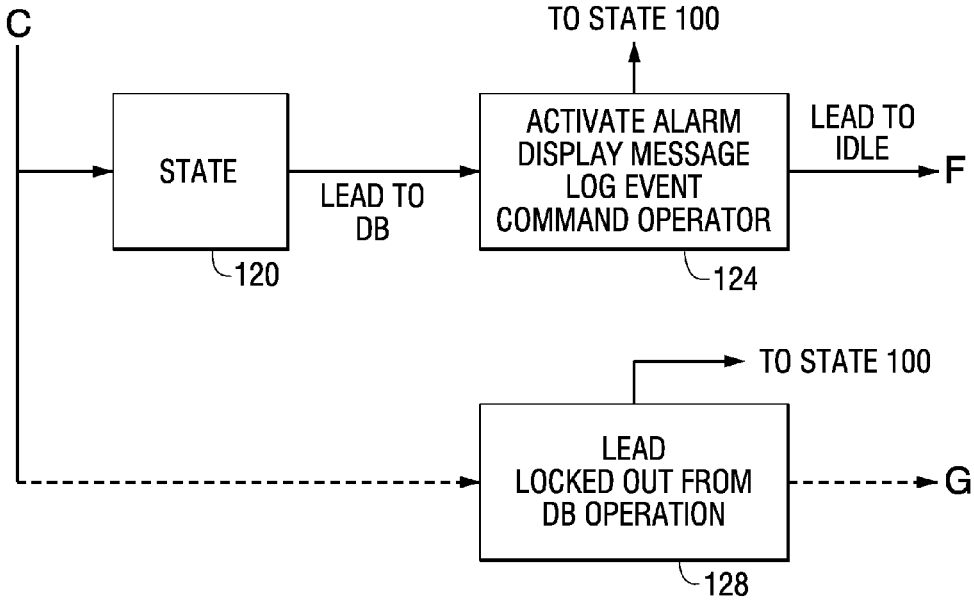

FIG. 1 schematically illustrates an exemplary distributed power train 10 in accordance with an exemplary embodiment of the invention. The train 10, traveling in a direction indicated by an arrowhead 11, includes a lead unit 14 and one or more remote units. An illustrated exemplary train 10 includes remote units 12A-12C controlled from either the lead unit 14 or a control tower 16. In one embodiment the control tower 16 communicates with the lead unit 14, which in turn communicates with the remote units 12A-12C. A locomotive 15 is controlled by operator actions in the lead unit 14 via an MU line 17 connecting the two units.

The distributed power train 10 further includes a plurality of railcars 20 between the lead unit 14 and the remote units 12A/12B and additional railcars 20 between the remote units 12A/12B and the remote unit 12C. The arrangement of the lead locomotive 14, the remote locomotives 12A-12C and railcars 20 illustrated in FIG. 1 is merely exemplary, as embodiments of the invention can be applied to other locomotive/railcar arrangements. Each railcar 20 includes an air brake system (not shown) that applies the railcar air brakes in response to a pressure drop in a brake pipe 22, and releases the air brakes responsive to a pressure rise in the brake pipe 22. The brake pipe 22 runs the length of the train for conveying the air pressure changes specified by the individual braking controller (not shown) in the lead unit 14 and the remote units 12A, 12B and 12C.

The lead unit 14, the remote units 12A, 12B and 12C and the control tower 16 each includes a transceiver 28 operative with an antenna 29 for receiving and transmitting communications signals over a communications channel of the distributed power communications system.

The lead unit transceiver 28 is associated with a lead station 30 for generating and issuing commands and messages from the lead unit 14 to the remote units 12A-12C, and receiving reply messages therefrom.

Commands are generated in the lead station 30 in response to operator control of the traction controller and the braking controller within the lead unit 14, as described above or automatically responsive to train operating conditions. Each remote unit 12A-12C includes a remote station 32, responsive to the transceiver 28, for processing and responding to transmissions from the lead unit 14 transmitted over the communications link (e.g., by applying tractive effort or brakes at the receiving remote unit) and for issuing reply messages (e.g., acknowledging receipt and implementation of a lead unit command) and status messages back to the lead unit 14.

For example, when the lead unit operator operates a lead-unit throttle handle to apply tractive effort from the lead unit, the distributed power control and communications system commands each remote unit to supply the same tractive effort. Upon execution of the received command, each remote unit responds to the lead unit with a status command indicating implementation of the tractive effort command. The distributed power control system can be configured to various operational modes that control interaction between the lead and remote units and implementation of lead unit commands at the remote unit.

In one embodiment, the communications channel of the communications system includes a single half-duplex communications channel having a 3 kHz bandwidth. The messages and commands include a serial binary data stream modulating one of four available carrier frequencies using frequency shift keying modulation. The various bit patterns convey information including the type of transmission (e.g., message, command, alarm); the substantive message, command or alarm; the address of the receiving unit; the address of the sending unit; conventional start and stop bits and/or error detection/correction bits. The messages allow control of the remote units 12A-12C from the lead unit 14 and provide remote unit operating information back to the lead unit 14. The details of the system messages and commands and the transmission format of individual messages and commands are described in detail in commonly-owned U.S. Pat. No. 4,582,280, which is hereby incorporated by reference.

Each message and command sent from the lead unit 14 is broadcast to all of the remote units 12A-12C and includes a lead unit identifier for use by the remote units 12A-12C to determine whether the sending lead unit is the lead unit of the same train. An affirmative determination causes the remote units 12A-12C to execute the received command. Messages and alarms sent from one of the remote units 12A-12C also include the sending unit's address. The receiving unit, i.e., the lead locomotive or another remote locomotive, can determine whether it is an intended recipient of the received transmission by checking the sending unit's identification in the message, and can then respond accordingly.

Each locomotive 14 and 12A-12C further includes a dynamic brake controller 38. Application of the dynamic brakes in the lead locomotive 14 generates a signal communicated to the remote units 12A-12C over the communications link. Responsive thereto, the remote station 32 controls the dynamic brake controller 38 of the remote units 12A-12C to activate dynamic braking. Generally, application of the dynamic brakes generates relatively uniform braking forces throughout the length of the train.

As the distributed power train passes through certain terrain topographies or track segments with proximate natural or man-made obstructions, a line-of-sight communications link between the sending and one or more of the receiving units may be interrupted. Thus, commands from the lead unit to the remote units and status messages from the remote units to the lead unit may not be reliably received. Although high-power, robust transceivers may be capable of successfully transmitting the signal to the receiving unit under certain operating conditions, such equipment can be relatively expensive. Further, in some operating scenarios even a high-power transceiver cannot successfully effect communications, such as when a long train travels a curved track segment adjacent a natural obstruction such as a mountain, where the communications path between the lead unit and one or more remote units is obstructed by the mountain. In addition, as the train passes through a tunnel certain transceivers may be unable to communicate with other transceivers aboard the locomotives. Thus, operation of the distributed power communications system may be interrupted for short periods during train operation.

To improve system reliability and avoid communications outage periods, one embodiment of the distributed power train communications system includes an off-board repeater 26 (see FIG. 1) for receiving messages sent from the lead unit 14 and repeating (retransmitting) the message for receiving by the remote units 12A-12C. This embodiment may be practiced along a length of track that passes through a tunnel, for example. The off-board repeater 26 includes a transceiver 28 and an antenna 29 for receiving and retransmitting lead messages.

Operation of the lead unit 14 and the remote units 12A-12C in dynamic braking mode may be recommended during a long descent. Soon after the lead unit 14 reaches level terrain, it is necessary to begin application of tractive effort to maintain train speed. The operator deactivates the lead unit dynamic brakes by operating the dynamic brake controller (typically including a continuous potentiometer marked to indicate about eight different degrees of dynamic brake applications) and controls the lead-unit throttle handle to apply the desired tractive force. Responsive thereto, the distributed power train control and communications system transmits a signal from the lead unit 14 to the remote units 12A-12C commanding deactivation of the dynamic brakes and operation of the remote units in traction mode wherein they also apply tractive forces to the train.

If the communications system is inoperative or if the communications link between the lead unit and one or more remote units is disrupted, the remote unit(s) may not receive the command to deactivate dynamic braking and apply traction. Thus, the lead unit supplies traction (pulling) while the remote units are braking (in dynamic braking mode), generating high in-train forces that can break the train apart and cause a derailment. These forces are represented in FIG. 1, where an arrowhead 40 represents the tractive force applied by the lead unit 14 and an arrowhead 41 represents the braking forces due to dynamic braking by the remote units 12A-12C. The consequences of this situation are exacerbated with increasing length and weight of today's trains.

The distributed power control and communications system includes a lead unit display indicating the operating status of each remote unit. In the event the communications system fails, the display maintains the last acknowledged operating command sent to the remote units. According to standard operating procedure, the lead operator consults the status information prior to controlling the lead unit to traction operation, thereby avoiding this dangerous situation. However, operators are prone to forget this important step, may not understand the serious consequences of their intended action or may not realize that the communications system is inoperative.

Embodiments of the invention teach a distributed power train control system that avoids certain operating scenarios (and/or provides a warning when certain operating scenarios occur) without operator attention. One such exemplary scenario includes a lead unit applying traction forces while the remote units are in dynamic braking. By monitoring the operating condition of the lead and remote units (e.g., traction, dynamic braking), the direction of train travel and the operability of the communications system, embodiments of the invention ensure that the operator cannot create an operating scenario where the lead unit is applying tractive forces while the remote units are in the dynamic braking mode (and vice versa for a train traveling in the reverse direction) or warn against such an operating scenario.

The embodiments teach an apparatus and process for determining a state of the distributed power communications system and the operating mode of the lead locomotive 14 and the remote locomotives 12A-12C. If the communications link to one or more of the remote units 12A-12C is not operating and one or more remote units 12A-12C are in a dynamic braking mode, one exemplary embodiment of the invention displays a warning message and/or activates an alarm to the lead unit operator, cautioning him against controlling the lead unit 14 to a traction state. In addition to or in lieu of the message/alarm, in another embodiment an interlock signal is generated that prevents application of tractive forces at the lead unit 14 if the operator manually operates the traction in an attempt to apply traction forces at the lead unit.

To determine the operating condition of the communications system, the lead unit 14 transmits a command message to all the remote units 12A-12C. In an exemplary embodiment the command message is transmitted about every 20 seconds. If each remote unit 12A-12C transmits a reply (also referred to as a status message), the lead unit 14 recognizes that the command message was received and the communications link is operating properly. In an exemplary embodiment, each remote unit that receives the command message responds in about two seconds after receiving the command message. In certain embodiments of the distributed power control and communications system, each remote unit repeats (retransmits) the lead unit's command message to increase the probability that all remote units receive the message.

If one or more remote units 12A-12C does not reply, a communications interrupt indicator is activated in the cab of the lead unit. In one exemplary embodiment the communications interrupt indicator includes an illumination device that is illuminated (activated) yellow. In an exemplary embodiment the lead unit 14 retransmits the command message about every two to three seconds until communications is restored. In this exemplary embodiment if after about 45 seconds all remote units 12A-12C have not responded, a sustained communications loss condition is declared. A second communications interrupt indicator is activated in the cab and the lead continues to retransmit the command message about every 2-3 seconds. In one embodiment, the second indicator includes turning the communication interrupt indictor from yellow to red.

When a remote locomotive enters the sustained communication interruption condition, it maintains the last commanded operation until one of the following occurs: communications with the lead unit 14 is restored, the remote unit senses a train brake application or release (by detecting a drop in brake pipe pressure or an increase in brake pipe charging flow) or a predefined time limit elapses (typically about 90 minutes).

FIGS. 2A-2D illustrate a state diagram depicting behavior of the system according to one embodiment of the invention. At a state 100 an operating condition of communications system is determined as described above by sending one or more command messages from the lead unit 14 to each of the remote units 12A-12C.

If the communication system is declared functional, the control system enters a state 108 where the lead unit operator controls the lead unit 14, and responsive thereto the remote units 12A-12C are controlled according to standard operating modes of the distributed power control and communications system. In one such operating mode, referred to as a normal operating mode, when the lead unit operator controls the lead unit to traction operation the remote units follow, switching to traction operation responsive to the lead unit command message. Similarly, when the operator switches the lead unit to dynamic braking operation the remote units switch to dynamic braking operation responsive to the command message.

In addition to the normal operating mode (where the remote units are in the same operational mode as the lead unit) the distributed power control and communications system can also operate in an independent mode where the remote units are controlled independently of the lead unit, i.e., the remote units do not follow the operating condition of the lead unit. If the system is at the state 108 of FIG. 2 (functional communications system) while configured to the independent operating mode, and if the remote units are in dynamic braking and the lead unit is controlled to traction, the lead unit recognizes this as an invalid operating condition and commands the remote units to an idle condition so that no remote tractive or braking forces are applied.

If the communications system is not fully functional, a state 112 follows the state 100 (via a path A) where an operating status of the lead and remote units and the direction of train travel are determined. If it is determined at the state 112 that the lead unit and all the remote units are in traction and the direction is forward (the lead unit 14 is at the head of the train) or reverse (the lead unit at the end-of-train position), the system enters a state 116 where no pertinent actions are executed. Instead, as described above, each of the remote units 12A-12C retains the last commanded operating condition until one of the conditions enumerated above occurs.

The system also continues to the state 116 if the lead unit and the remote units are all in dynamic braking and the direction is forward or reverse. Finally, the system continues to the state 116 if the lead unit is in dynamic braking mode and the remote units are in traction mode for a forward travel direction, and if the remote units are in dynamic braking mode and the lead unit is in traction mode for a reverse travel direction. Although the latter two conditions can generate "pushing" forces on the railcars, the railcars have a sufficiently large force rating to counteract the "pushing" forces.

If the action at the state 112 determines that the remote units 12A-12C and the lead unit 14 are in traction while the direction of train travel is reverse the system enters a state 120 via a path C. From the state 120, if the lead unit 14 is controlled to dynamic braking operation the system enters a state 124 where one or more of the listed actions is executed according to various embodiments of the invention: an alarm (referred to as a lead/remote traction/dynamic brake alarm) is activated in the operator's cab of the lead unit 14, a message is displayed on a display in the lead unit cab and an event is automatically recorded in a train operating or event log. Log entries are automatically entered according to various train conditions and operating events, besides the events associated with the embodiments of the present invention. One exemplary displayed message is, "Train Stretch Warning. Set Lead to Idle." The operator is thereby commanded to the set the lead to an idle condition to avoid the application of the train stretch forces. Alternatively, the operator can be commanded to return the lead to traction operation, although this option is not desired if the operator is attempting to slow the train.

A state 126 indicating the train is properly configured is entered via a path F when the operator commands the lead unit to idle (or traction) operation.

In another embodiment, a state 128 follows the state 112 via the path C when it is determined that the lead and remote units are in traction operation while the direction of travel is reverse. At the state 128, the lead unit 14 is locked to prevent operation of the dynamic brakes. To accomplish the lock condition, an interlock relay is energized or a dynamic braking kill signal is generated and supplied to the lead unit engine controller, preventing operation of the lead unit dynamic brakes irrespective of the position of the dynamic brake controller as manually manipulated by the train operator. Additionally, the warnings/alarms of the state 124 can be included with the lock-out condition of the state 128. From the state 128 the system reverts to the state 112 via a path G.

In yet another embodiment, a warning message can be provided at the state 120 to advise the operator of the train's condition and warn the operator that controlling the lead unit to dynamic braking operation will impose high in-train forces.

If the action at the state 112 determines that, the lead unit 14 and the remote units 12A-12C are in dynamic braking and the direction of train travel is forward, the system transitions to a state 140 via a path B. From the state 140, if the lead unit 14 is controlled to traction operation the system enters a state 144 where one or more of the listed actions is executed according to one or more embodiments of the invention: an alarm (referred to as a lead/remote traction/dynamic brake alarm) is activated in the cab of the lead unit 14, a message is displayed on a display in the lead unit 14 and an event is automatically recorded in a train operating log. One exemplary displayed message is "Train Stretch Warning. Set Lead Unit to Idle." The state 126 is reached via a path D when the operator commands the lead unit 14 to idle operation. Alternatively, the operator can be advised to return the lead to dynamic braking operation.

In another embodiment, a state 148, where the lead unit 14 is locked to prevent traction operation, follows the state 112. Additionally, the warnings/alarms/operations of the state 144 can combined with the lock-out state 148. The system returns from the state 148 to the state 112 via a path E.

In yet another embodiment, a warning message can be provided at the state 140 to advise the operator of the train's condition and warn the operator that controlling the lead unit to traction operation will impose high in-train forces.

Periodically, typically about every two or three seconds in one embodiment, the communications system operation is tested, indicated by a transition from the states 124, 128, 144, 148 and 126 to the state 100. When system operation is restored, the warnings/alarms/operations of the states 124 and 144 are discontinued and the system transitions to the state 108, allowing the operator to manually control the lead unit 14, with the remote units 12A-12C responding to commands issued from the lead unit 14 as described above.

Figure 3:
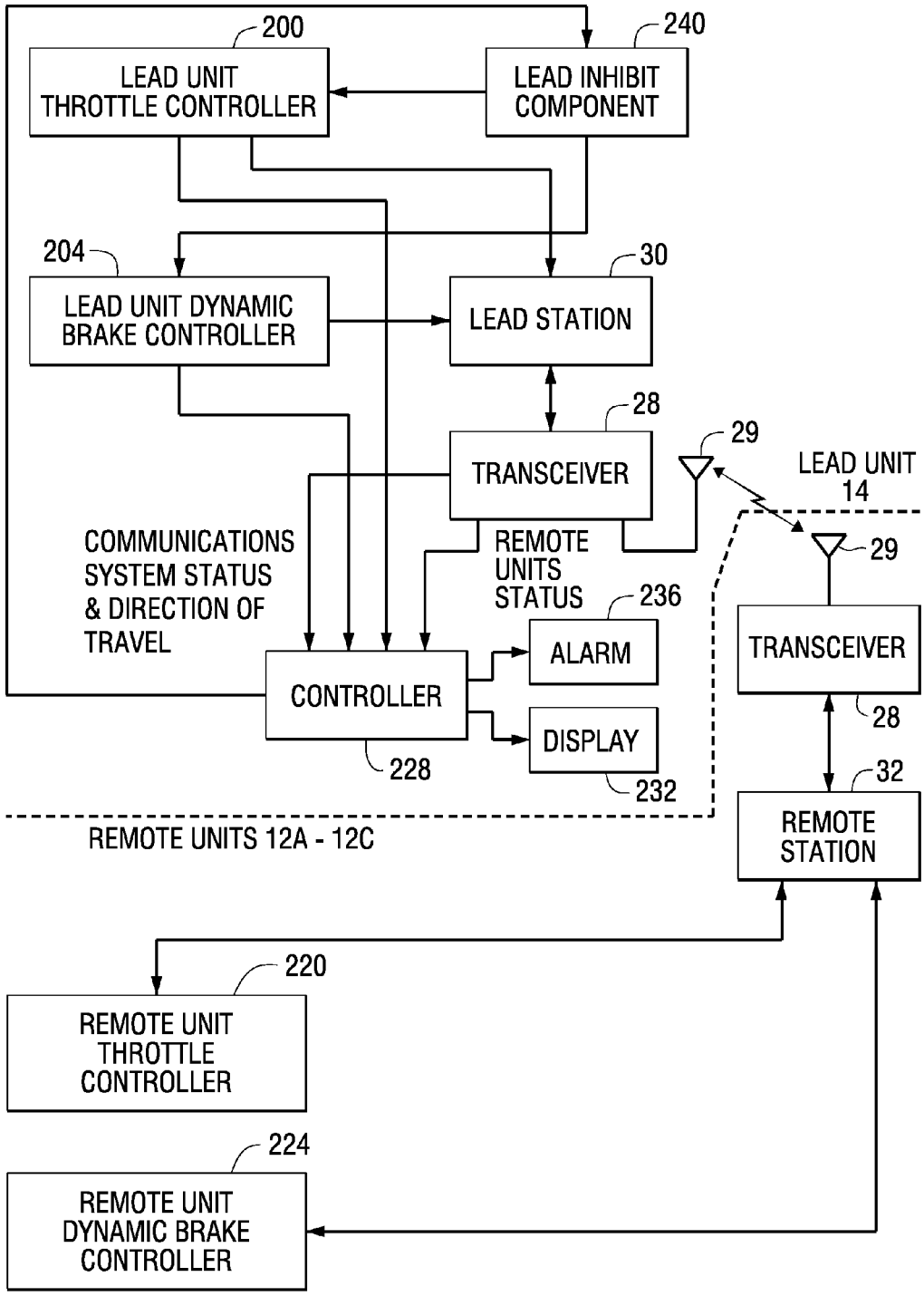
FIG. 3 is a block diagram illustrating pertinent components of an exemplary embodiment of the present invention.

FIG. 3 illustrates hardware components of the lead unit 14 and one of the remote units 12A-12C in accordance with an exemplary embodiment of the present invention. A lead unit throttle controller 200 and a lead unit dynamic brake controller 204 are controlled by the operator to respectively apply traction and dynamic brakes at the lead unit 14. The lead station 30 formulates commands responsive to the position of the throttle controller 200 and dynamic brake controller 204. The commands are transmitted by the transceiver 28 to the remote units 12A-12C via the antenna 29.

The commands are received by the remote unit antenna 29 and processed through the remote unit transceiver 28 and the remote station 32, for controlling the remote unit throttle controller 220 and the remote unit dynamic brake controller 224 in each of the remote units 12A-12C (only one illustrated in FIG. 3).

A controller 228 in the lead unit 14 is responsive to status signals from the remote units 12A-12C, via the transceiver 28, indicating the operational status of these remote units (e.g., traction mode or dynamic braking mode). The controller 228 is further responsive to a signal indicating the train's direction of travel, signals from the lead unit throttle controller 200 and the lead unit dynamic brake controller 204 indicating the status thereof and a signal indicating the status of the communications system.

As described above, when the controller 228 determines that the communications system is not operational, the lead unit 14 and the remote units 12A-12C are in traction operation, the travel direction is reverse and the operator controls the lead unit to dynamic braking operation, the controller 228 controls a lead unit display 232 to display the messages and activate a lead unit alarm 236 as described above in conjunction with FIGS. 2A-2D. An event may also be logged in an event log 238.

In another embodiment, responsive to the conditions that the communications system is not operational, the lead unit 14 and the remote units 12A-12C are in traction operation and the travel direction is reverse, the controller 228 controls a lead inhibit component 240 to supply a signal to the lead unit dynamic brake controller 204. The lead inhibit component 240 prevents operator control of the lead unit to dynamic braking, thereby avoiding the creation of high in-train forces.

When the controller 228 determines that the communications system is not operational, the lead unit 14 and the remote units 12A-12C are in dynamic braking operation, the direction of travel is forward and the operator controls the lead unit to traction operation, the controller 228 controls the lead unit display 232 and activates the lead unit alarm 236.

In another embodiment, responsive to the conditions that the communications system is not operational, the lead unit 14 and the remote units 12A-12C are in dynamic braking operation and the travel direction is forward, the controller 228 controls the lead inhibit component 240 to supply a signal to the lead unit throttle controller 240 that prevents the operator from controlling the lead unit to traction operation by manual operation of the throttle controller 200 to avoid creating potentially-damaging high in-train forces.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for controlling a rail vehicle consist including a first rail vehicle and a second rail vehicle, the rail vehicle consist coupled to at least one rail car forming a train, each of the first and second rail vehicles being operable in a traction mode and a braking mode, the method comprising:

determining an operational status of a communications link between the first rail vehicle and the second rail vehicle;

determining an operational mode of each of the first and the second rail vehicles;

determining a direction of travel of the train; and activating an alarm in the first rail vehicle in response to a shift of the operational mode of the first vehicle from traction to a braking mode, the step of activating an alarm requiring the communications link between the first rail vehicle and the second rail vehicle to be inoperable, the direction of travel of the train being reverse, and the operational mode of both of the first and the second rail vehicles being traction.

2. The method of claim 1 wherein activating the alarm further comprises displaying a message in the first rail vehicle.

3. The method of claim 1 further comprising recording an event in a log of the first rail vehicle following activation of the alarm.

4. The method of claim 1 further comprising issuing a command directing an operator to shift the first rail vehicle to an idle mode following activation of the alarm.

5. The method of claim 1 further comprising issuing a command directing an operator to shift the first rail vehicle to the traction mode following activation of the alarm.

6. The method of claim 1 further comprising periodically retesting the status of the communications link following identifying a failure.

7. The method of claim 1 wherein determining the communications link between the first rail vehicle and the second rail vehicle to be inoperable comprises:

transmitting a command message from the first rail vehicle to the second rail vehicle; and failing to receive a message at the first rail vehicle from the second rail vehicle in response to the command message.

8. A method for controlling a rail vehicle consist including a first rail vehicle and a second rail vehicle, the rail vehicle consist coupled to at least one rail car forming a train, each of the first and second rail vehicles being operable in a traction mode and a braking mode, the method comprising:

determining an operational status of a communications link between the first rail vehicle and the second rail vehicle;

determining an operational mode of each of the first and the second rail vehicles;

determining a direction of travel of the train; and locking of the operational mode of the first rail vehicle for preventing braking of the first rail vehicle, the step of locking requiring the communications link between the first rail vehicle and the second rail vehicle to be inoperable, the direction of travel of the train being reverse, and the operational mode of both of the first and the second rail vehicles being traction.

9. The method of claim 8 further comprising activating an interlock for preventing dynamic braking of the first rail vehicle.

10. A method for controlling a rail vehicle consist including a first rail vehicle and a second rail vehicle, the rail vehicle consist coupled to at least one rail car forming a train, each of the first and second rail vehicles being operable in a traction mode and a braking mode, the method comprising:

determining an operational status of a communications link between the first rail vehicle and the second rail vehicle;

determining an operational mode of each of the first and the second rail vehicles;

determining a direction of travel of the train; and activating an alarm in the first rail vehicle in response to a shift of the operational mode of the first vehicle from braking to a traction mode, the step of activating an alarm requiring the communications link between the first rail vehicle and the second rail vehicle to be inoperable, the direction of travel of the train being forward, and the operational mode of both of the first and the second rail vehicles being braking.

11. The method of claim 10 wherein activating an alarm further comprises displaying a message in the first rail vehicle.

12. The method of claim 10 further comprising recording an event in a log of the first rail vehicle following activation of the alarm.

13. The method of claim 10 further comprising issuing a command directing an operator to shift the first rail vehicle to an idle mode following activation of the alarm.

14. The method of claim 10 further comprising issuing a command directing an operator to shift the first rail vehicle to the braking mode following activation of the alarm.

15. The method of claim 10 further comprising displaying a warning message in the first rail vehicle, the warning message including a notification as to the operational modes of the first and second rail vehicles.

16. The method of claim 10 wherein determining the communications link between the first rail vehicle and the second rail vehicle to be inoperable further comprises:

transmitting a command message from the first rail vehicle to the second rail vehicle; and failing to receive a message at the first rail vehicle from the second rail vehicle in response to the command message.

* * * * *